United States Patent [19]

Lord et al.

[11] 4,369,725

[45] Jan. 25, 1983

[54] METHOD AND MEANS FOR INCREASING THE MANEUVERABILITY OF A SHIP IN ICE-COVERED WATERS

[75] Inventors: Steven M. Lord, Stoneham, Mass.; Hiroshi Tabuchi, Tokyo, Japan

[73] Assignee: Mitsui Engineering & Shipbuilding Co., Ltd., Tokyo, Japan

[21] Appl. No.: 213,641

[22] Filed: Dec. 5, 1980

Related U.S. Application Data

[63] Continuation-in-part of Ser. No. 920,797, Jun. 30, 1978, abandoned.

[51] Int. Cl.³ ..... B63B 35/10

[52] U.S. Cl. ..... 114/40; 114/56

[58] Field of Search ..... 114/40, 41, 42, 56, 114/121, 125, 144 R, 152

[56] References Cited

U.S. PATENT DOCUMENTS

| | | | |
|---|---|---|---|
| 3,192,888 | 7/1965 | Field | 114/125 |
| 3,489,117 | 1/1970 | Messerschmidt | 114/56 |
| 3,667,416 | 6/1972 | Fioravanti et al. | 114/42 |
| 3,872,814 | 3/1975 | Rodriguez | 114/40 |
| 4,326,476 | 4/1982 | Pole | 114/40 |

FOREIGN PATENT DOCUMENTS

| | | | |
|---|---|---|---|
| 2212145 | 9/1973 | Fed. Rep. of Germany | 114/40 |
| 2212146 | 9/1973 | Fed. Rep. of Germany | 114/40 |
| 54-72891 | 6/1979 | Japan | 114/40 |
| 1690 | of 1905 | United Kingdom | 114/56 |

*Primary Examiner*—Charles E. Frankfort

*Attorney, Agent, or Firm*—Armstrong, Nikaido, Marmelstein & Kubovcik

[57] ABSTRACT

The disclosed method for increasing the maneuverability of a ship in ice-covered waters is comprised of bringing generally vertical ice-crushing surfaces on one side of a ship into contact with an ice covering in order to create an imbalance of forces between that side of the ship and the ice covering in comparison with the forces between the other side of the ship and the ice covering in order to assist in turning the ship. The generally vertical ice-crushing surfaces are positioned on both a starboard and port side of the hull of the ship in such a manner that they remain out of contact with the ice covering normal straight forward travel. A particular positioning mechanism is utilized in order to bring a generally vertically oriented ice-crushing wall portion into contact with the ice covering. Contact between the generally vertically oriented ice-crushing wall portion and the ice creates a crushing force between the two surfaces, while the other side of the ship contacts the ice at a different angle applying a bending force to the ice covering. The different forces applied to the sides of the ship create a horizontal force inbalance which forces the ship away from the side where the ice-crushing forces are created between the ice and the generally vertically oriented wall portions, thus turning the ship away from that side.

11 Claims, 13 Drawing Figures

METHOD AND MEANS FOR INCREASING THE MANEUVERABILITY OF A SHIP IN ICE-COVERED WATERS

This application is a continuation-in-part of application Ser. No. 920,797, filed June 30, 1978, and now abandoned.

BACKGROUND OF THE INVENTION

1. Field of the Invention

The present invention is directed to a method and means for improving the maneuverability of a ship in ice-covered waters. More particularly, the invention is directed to a method and means for increasing the maneuverability of an ice-breaking cargo vessel which is navigating through ice-covered waters. The particular method includes positioning a means, which is in part comprised of a vertically oriented ice-crushing wall portion, into contact with ice on one side of the ship in order to create an imbalance of forces between that side of the ship and the other side, thereby forcing the ship toward said other side.

2. Description of the Prior Art

Discovery of oil fields and natural gas in the artic has led to an increased interest in the development of ice-breaking cargo vessels and/or tankers for use in transporting these resources to refineries and consumers at remotely situated markets. The cargo and/or tanker ships must operate efficiently during the transportation of their cargo. In order to operate efficiently, they must maintain a satisfactory speed with a relatively low fuel consumption. In order to meet these efficiency requirements, conventional ship designs have been developed. Such conventional designs have a low value of ship-ice resistance per unit cargo capacity. Such conventional designs are generally characterized by a relatively large length-to-beam ratio, fine bow forms and long parallel middle-body sections. Such hull designs allow the ship to perform efficiently during normal travel through non-ice-covered waters, and to perform well during straight travel through ice-covered waters. However, due to their relatively long parallel middle body sections, these conventional ships have poor maneuverability in ice-covered waters. The poor maneuverability of the conventional design has presented serious problems when attempting to turn these ships in order to change course in ice-covered waters to avoid objects, such as a major ice ridge or for maneuvering the ship into a docking facility. Accordingly, the poor maneuverability of such conventional designs within ice-covered waters deterimentally affects the safe operation and time required to effectively dock and position the vessel.

In order to avoid the above-mentioned safety hazards and attempt to minimize the transit time required to specifically maneuver the vessel, other ships have been designed to serve as the primary ice-breaking vessels. Such vessels escort the conventional cargo ships, clearing the path in front of the cargo ship. Such ice-breaking ships must have both a high maneuverability in the ice and cut a wide channel for the cargo vessel in which to follow. The necessary maneuverability, and ability to form a wide channel are made possible by providing such ice-breaking vessels with a stocky, rounded hull with a relatively low length-to-beam ratio, typically in the range of 4.0 to 5.5, such as disclosed in U.S. Pat. No. 857,766. The water plane-shape of this type of hull enables a certain degree of turning within the confines of the channel cut by the ship's beam. However, such a high beam-to-displacement ratio makes such a vessel configuration unsuitable as a cargo vessel. The high beam-to-displacement ratio results in a relatively high power requirement per unit cargo capacity which is moved. Furthermore, this high beam-to-displacement ratio results in an increased open water resistance per unit displacement. Therefore, such vessels do not travel efficiently through ice-covered or non-ice-covered waters.

Another design which has been developed in order to increase the maneuverability of a cargo ship in ice-covered waters includes a wide beam forward configuration, such as that disclosed within Canadian Pat. No. 947,482. The object of the wide beam forward design is to cause the ship's bow to cut a sufficiently wide channel through the ice to allow a relatively narrow middle body and stern to swing outward to either side during a turning maneuver. This concept has been embodied in a converted tanker SS Manhattan. While the wide beam forward design does provide a certain degree of improved turning capability in ice-covered waters, it suffers to some extent from the same effects as the stocky, rounded hull escort vessel discussed above. The wide beam forward configuration requires greater propulsion power per unit displacement in order to break through the ice than is required by an equivalent sized ship having a relatively high length-to-beam ratio. Therefore, although the wide beam forward configuration allows for greater maneuverability during turns in ice-covered waters, the design is inefficient for straight forward travel through ice-covered or non-ice-covered waters. The conventional fine hull shape with a long, parallel middle body section is a fuel efficient design. The fuel efficiency of this design is sacrificed to achieve improved maneuverability when the wide beam forward design is utilized.

Another prior art approach to the design of a more maneuverable ice-breaking cargo ship is the provision of a hull form characterized by a scooped-out section in the vicinity of the ice-breaking water line rearward from the point of maximum beam, such as disclosed in U.S. Pat. No. 3,727,571. The design of this hull is similar to that of the SS MANHATTAN-type hull discussed above, with the exception that the cargo capacity is increased by flaring the hull out to its maximum beam below the ice-breaking water line. While, to a lesser extent than the SS MANHATTAN-type hull design, the scooped-out hull design also loses cargo capacity and fuel efficiency at the expense of improved maneuverability within ice-covered waters.

SUMMARY OF THE INVENTION

The primary objects of this invention are to provide methods and means for increasing the maneuverability of a ship in ice-covered waters.

Another object is to provide a means for maneuvering a ship through a turn in ice-covered waters by bringing a substantially vertically oriented portion of the ship's hull into contact with an ice covering.

Still another object is to provide a plurality of different means comprised of a vertically oriented ice-crushing portion on a ship's hull which is out of contact with an ice covering on the surface of water during the straight forward travel of the ship.

A further object of the invention is to provide a ship's hull which is highly maneuverable in ice-covered waters. A still further object is to provide a maneuvering apparatus which is adapted to change the waterplane-shape of the ship's bow during maneuvering in ice.

Another object is to provide a maneuvering apparatus which changes the waterplane-shape of a ship's bow during maneuvering in ice to create an imbalance in the forces on the port and starboard sides of the ship to thereby create a net generally normal acting, pushing force on one side of the ship's hull.

Another object is to provide a method for maneuvering a vessel in ice-covered waters by creating an imbalance in forces between the ice covering on the port and starboard sides of the ship, thereby giving rise to a resultant pushing force on one side of the ship's hull.

Another object is to provide an apparatus having a generally vertically oriented ice-crushing surface positioned on both the port and starboard sides of the hull above the normal water line of the hull during straight forward operation and a cooperating positioning mechanism adapted to selectively bring one of the port or starboard vertically oriented ice-crushing surface portions into contact with the ice covering.

Conventional ships having the high length-to-beam ratios are capable of efficiently carrying large amounts of cargo through water. The present invention allows for such efficient hull designs to be maintained. In addition, the present invention provides a means which can be used in connection with such efficient hull designs and which enables the efficient hull designs having the high length-to-beam ratios to be substantially more maneuverable in ice-covered waters. The disclosed method of increasing the ice-covered water maneuverability of a ship having a high length-to-beam ratio involves positioning a turn-assisting element of the present invention, on one side of the ship's hull into contact with an ice covering. When the ship is not being turned, the turn-assisting elements on either side of the ship are not in contact with the ice covering. This allows the ship to move through the water in its normal fuel efficient manner.

The turn-assisting means of the present invention includes three basic types of turn-assisting elements. These turn-assisting elements are positioned on each side of a conventional hull. The conventional hull includes both port and starboard portions having a sloped configuration for applying a generally symmetrical force to the ship. Accordingly, as the hull of the conventional ship moves through the water, a generally symmetrically distributed bending force is applied to the hull by the ice-covering on either side of the vessel during straight-forward travel. Since the turn-assisting elements are not in contact with the ice covering during straight-forward travel, the hull continues to have a generally symmetrically distributed force applied to it. However, the turn-assisting means include generally vertically oriented ice-crushing wall portions. When the vessel is to be turned, the generally vertically oriented ice-crushing wall portions of the turn-assisting elements on one side of the ship are brought into contact with the ice on that side of the ship. The turn-assisting elements on the opposite side of the ship are maintained out of contact with the ice covering. The contact between the ice and the generally vertically oriented ice-crushing wall portions causes a large amount of force to be applied between the ice and the vertical wall portions. The applied force pushes the ship away from the ice, thus assisting in the turning maneuver. The turn-assistance is due to the imbalance of forces created on the opposite sides of the ship. The imbalance in forces is due to the great disparity between the amount of force required to crush the ice with the vertically oriented ice-crushing wall portions on one side of the ship, and bend and break the ice with the sloped configuration on the opposite side of the ship. The great disparity between the amount of force required to crush ice and the amount of force required to bend the ice creates a force vector moving the ship in the direction away from the side of the ship which must crush the ice. This force vector greatly assists in turning the ship, making it possible to turn the ship much more quickly than is possible utilizing a conventional method, such as a rudder alone.

These and other objects and advantages of the present invention will become apparent to those skilled in the art upon reading the details of construction and usage as more fully set forth below, wherein reference is made to the accompanying drawings forming a part hereof wherein like numerals refer to like parts throughout.

DETAILED DESCRIPTION OF THE PREFERRED EMBODIMENTS OF THE INVENTION

Before the present method and means for improving the maneuverability of an ocean-going vessel are specifically described, it is to be understood that this invention is not limited to the particular arrangement of parts or steps, as such methods and devices may vary. It is also to be understood that the terminology used herein is for purposes of describing particular methods and embodiments only. It is not intended to be limiting since the scope of the present invention will be limited only by the appended claims.

Figure 4:
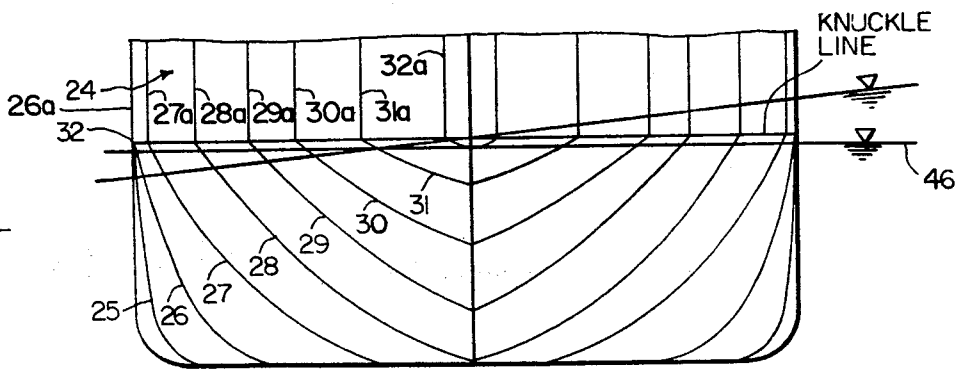
FIG. 4 is an elevational body plane view of a second embodiment of the invention wherein the bow form is provided with vertical surfaces above the normal ice-breaking water line.
Figure 5:
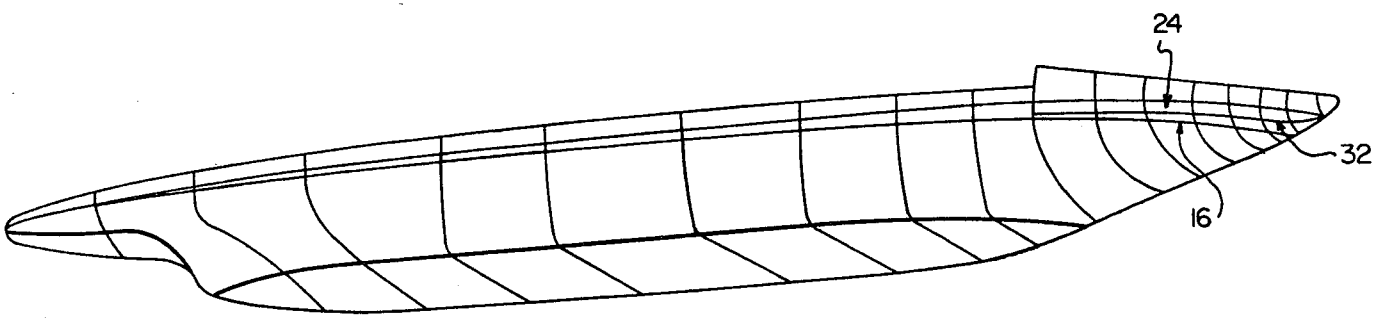
FIG. 5 is a perspective view of the embodiment illustrated in FIG. 4 showing the ice-breaking cargo vessel hull form.
Figure 6:
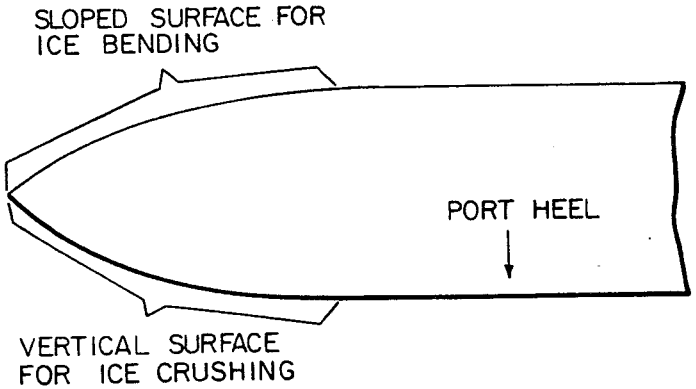
FIG. 6 is a plan view at the waterplane of the embodiment illustrated in FIG. 4 as it would appear when heeled to the port for a starboard turn.
Figure 8A:
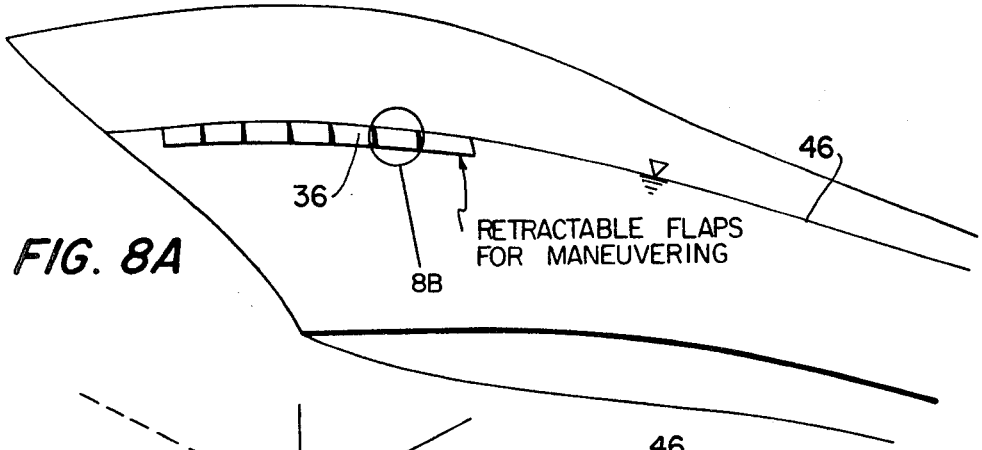
FIG. 8A is a perspective view of the forward portion of an ice-breaking cargo vessel illustrating a third embodiment of the invention wherein movable flaps are provided for changing the hull scope during maneuvering.
Figure 8B:
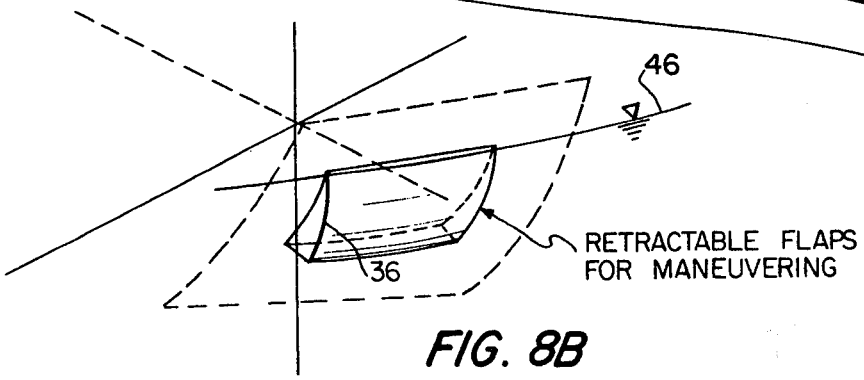
FIG. 8B illustrates the detail of a single flap provided in the embodiment of FIG. 8A.

Referring to the drawings, a first embodiment of the invention is disclosed in FIGS. 1A, 1B, 1C, 2 and 3. The first embodiment of the invention includes the blister-like protrusions positioned on the port and starboard sides of the hull. A second embodiment of the invention is disclosed within FIGS. 4, 5 and 6. A second embodiment comprises generally vertically oriented side wall portions as part of the hull. A third embodiment of the invention is disclosed in FIGS. 8A, 8B, 9 and 10. The third embodiment comprises a series of flaps positioned along both the port and starboard sides of the hull. Each of the three embodiments disclosed are capable of being positioned such that they present a generally vertically oriented ice-crushing wall portion to an ice covering on the surface of the water.

Figure 1A:
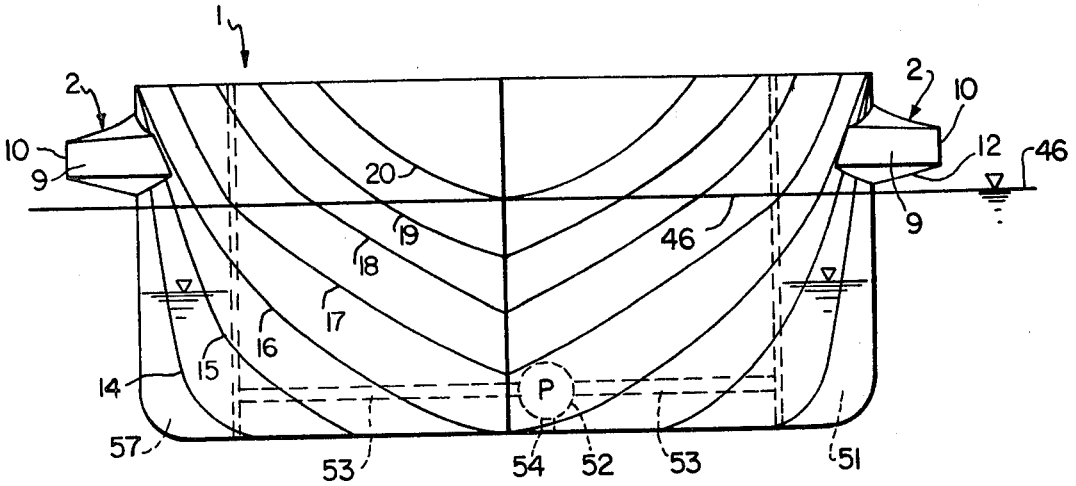
FIG. 1A is an elevational view of a first embodiment of the invention showing the blister-like hull protrusions of the invention positioned on either side of an ice-breaking vessel during straightforward travel, and showing a heeling means within that vessel.

FIG. 1A shows the hull form 1 which is a type generally suitable for navigation in ice-covered waters, with the blister-like protrusions 2 of the present invention attached on the hull 1 near its front portion 3. The hull form 1 is of the type having the relatively high length-to-beam ratio which is capable of efficient movement of cargo through the water.

Figure 1B:
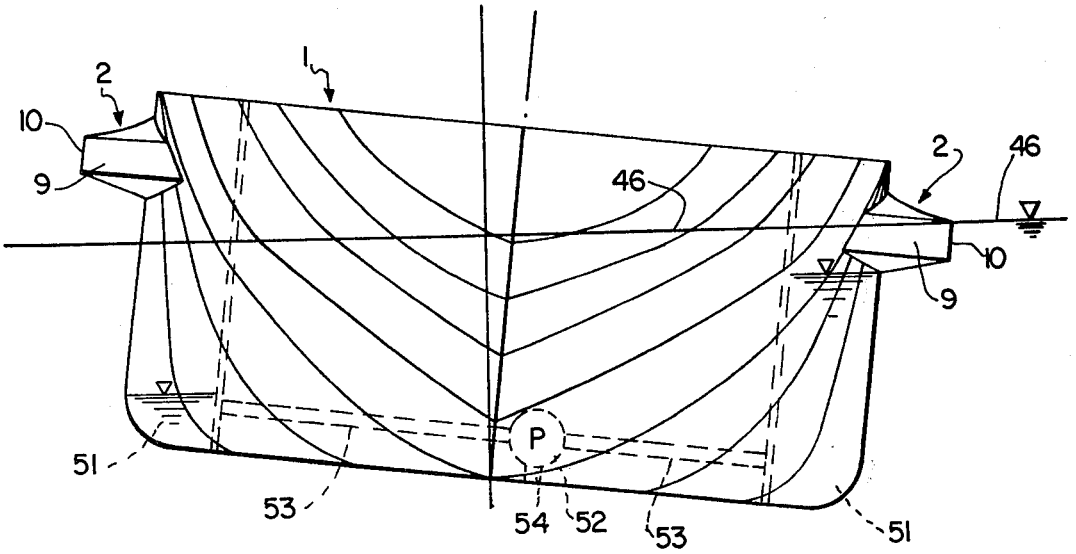
FIG. 1B is a view similar to FIG. 1A illustrating the positioning of the blister-like hull protrusions during a starboard turn as the vessel is heeled to the port.
Figure 2:
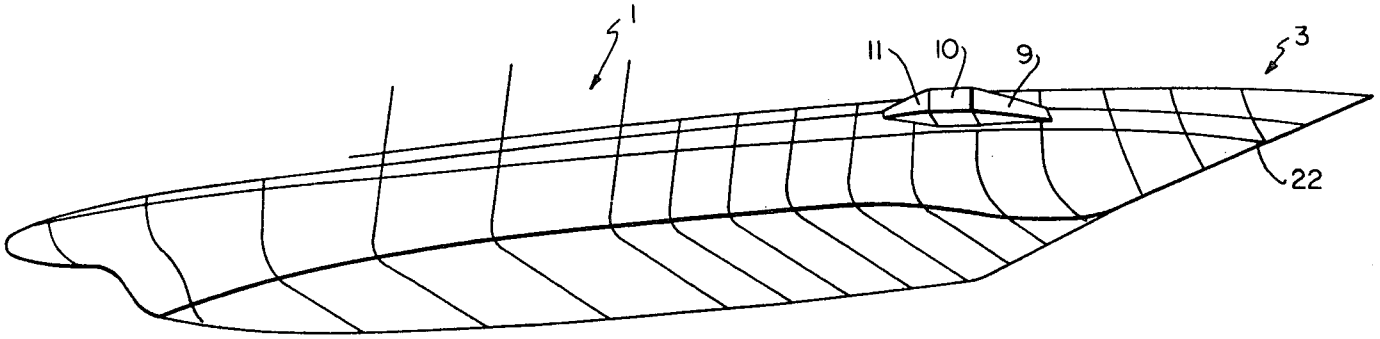
FIG. 2 is a perspective view of the blister-like hull protrusions and ice-breaking cargo vessel hull illustrated in FIG. 1A.
Figure 3:
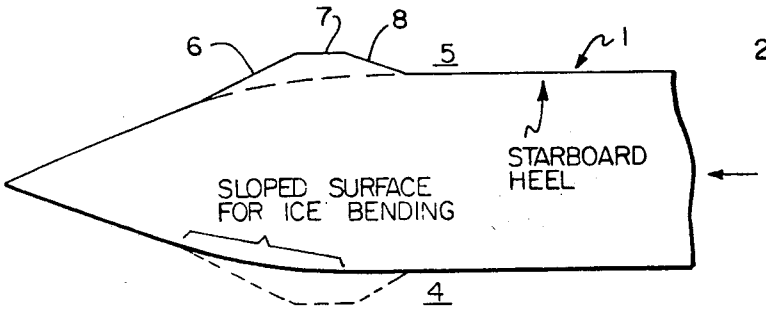
FIG. 3 is a sectional plan view at the waterplane of the blister-like hull protrusions and ice-breaking cargo vessel hull illustrated in FIG. 1A as they would appear when heeled to starboard for a port turn in ice.

The blister-like protrusions 2 can be seen more fully from a different angle within FIG. 2. The protrusions 2 are symmetrically positioned on the port 4 and starboard 5 sides of the hull 1. Each of the protrusions 2 include a forward edge 6, a central edge 7 and a trailing edge 8 as shown in FIG. 3. Each of the edges 6, 7 and 8 of the protrusions 2 comprise generally vertically extending wall surfaces 9, 10 and 11, respectively, as shown in FIG. 2. The lower edge surfaces 12 of the blister-like protrusions 2 shown in FIG. 1A are angled upward in order to assist in preventing wave pounding when the vessel is travelling in open water. The vertically extending wall portions 9 on each of the blisters 2 angles gradually away from the hull 1 until meeting the vertically extending wall surfaces 10, which is positioned such that its surface is generally normal to the surface of the water or angled slightly such that it will be normal to the surface of the ice when the ship is heeled to one side as shown in FIG. 1B. The vertical center line of the ship is shown by the number 55.

The frame lines 14–20 indicate the general contours of the hull 1 which has a generally sloped configuration. The generally sloped configuration of the hull 1 does not present any generally vertically extending wall surfaces other than those surfaces which are included as part of this invention. In FIG. 1A, the line 46 indicates the upper level of a water ice-covering relative to the hull when the ship is travelling in a straightforward direction through ice-covered waters. During the straightforward travel as shown in FIG. 1A, the blister-like protrusions 2 are positioned above the ice covering. Therefore, the blisters 2 do not affect the ice-breaking resistance of the hull while the ship is travelling in a straightforward direction. Therefore, the hull form below the water line may be optimized in any desired manner for straightforward movement through ice-covered waters or through non-ice-covered waters. The most efficient hull design, therefore, can be utilized without regard to redesigning the hull in order to attempt to increase maneuverability within ice-covered waters.

The precise shape and positioning of the blister-like protrusions 2 may be varied in accordance with each particular hull shape, hull structural strength, docking facility width limitations, expected ice operating thickness and ship heeling and trimming capabilities. It is generally preferred that the blister-like protrusions 2 extend outward beyond the maximum beam of the hull. The extension of the blister-like protrusions 2 beyond the maximum beam permits increased contact with a broken ice edge created by the forward portion 22 of the bow. Furthermore, the outward extension of the blister-like protrusions beyond the maximum hull beam permits increased clearance between the unbroken ice sheet and the sides of the ship on the outside of a turn. The increased clearance permits the stern to swing somewhat to the outside, thereby resulting in a somewhat tighter turn.

When docking facilities require a minimum beam, the blister-like protrusions may be moved forward on the hull. The positioning of the protrusions 2 forward on the hull decreases the effect of the blister-like protrusions 2 to increase the hull beam. It is preferred that the blister-like protrusions be positioned no further rearward than the most forward point of maximum beam. When the protrusions are positioned at the point of maximum beam width, the length of the moment arm through which the crushing forces operate in forcing the hull to turn is maximized. A further advantage obtainable by extending the blister-like protrusions beyond the ship's beam is a resulting increased ability to cut away at the sides of the channel generated by the ship's passage through the ice during "back and fill" turns, i.e., turns where the ship backs up and advances repeatedly within the space of a few ship lengths, thereby breaking away the ice on the channel with each pass until a sufficiently wide space is cleared for a tight turn.

FIG. 1B shows the position of the hull relative to the water ice-covering when the ship is performing a starboard maneuver. The port side blister-like protrusion 2 has been lowered into contact with the water ice-covering. FIG. 2 illustrates a perspective view of the hull and one of the blister-like protrusions 2. FIG. 3 is a sectional plan view taken at the waterplane of the first embodiment shown in FIG. 1B heeled to starboard for a port turn.

Any conventional ballasting or heeling means may be used in the present invention as for example the ballasting means of British Pat. No. 1,253,219 which is incorporated herein by reference.

In order to position a protrusion 2 in contact with the ice-covering as shown in FIG. 1B, the ballasting means or a cargo shifting means in the ship is utilized. Ballasting tanks 51 are provided along the port side 4 and the starboard side 5 of the hull. The ballasting tanks 51 are connected via pipes 53 to a pump 52. A pipe 54 is utilized for introducing sea water into the ballasting tanks 51 by means of the pump 52. As shown in FIG. 1A, both sides of the ballasting tanks 51 contain equal amounts of water during straightforward travel of the vessel. When the ship is to make a starboard maneuver, the port side 4 is lower as shown in FIG. 1B. The port side is lowered by moving a portion of the fluid in ballasting tank 51 on the starboard side 5 to ballasting tank 51 on the port side 4 by means of the pump 52 through the pipe 53. The amount that the ship is heeled to one side can be varied, depending upon the size and positioning of the protrusion 2 and the effect which the navigator desires to obtain from the invention.

Figure 1C:
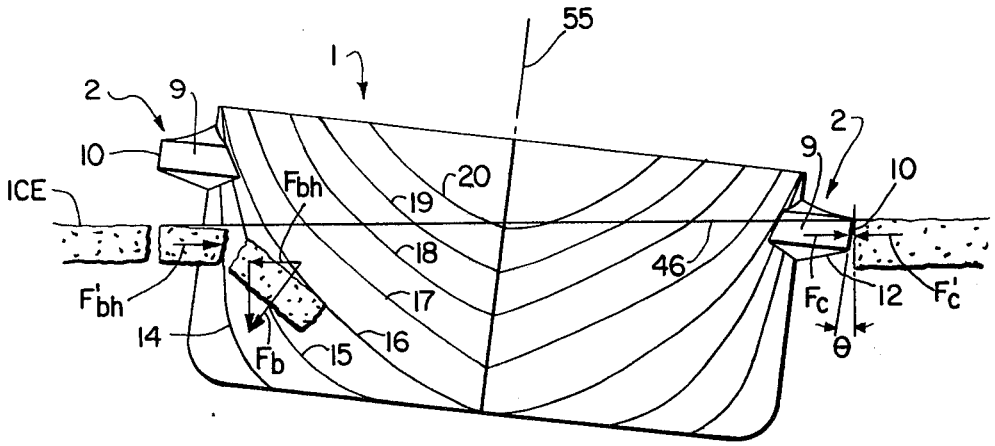
FIG. 1C is a similar view to FIG. 1B showing the ship during a starboard maneuver in contact with an ice covering and showing force vectors.

The allowable angle variation of a generally vertically oriented ice-crushing surface from the real vertical plane, i.e., the angle $\theta$ shown in FIG. 1C varies, depending on the coefficient of friction between the ice and the surface of the hull (or wall surface 10) in contact with the ice. If there is a great deal of friction between the surface of the hull and the ice in contact with the surface of the hull, a crushing force will be applied against the ice, rather than a bending force, even if the ice-crushing surface has some angle variation from the real vertical plane. However, if only a very small amount of friction exists between the surface of the hull and the ice, the wall surfaces 9, 10 and 11 on a protrusion 2 have to be really vertical or nearly vertical while contacting the ice during a turn in order to create a crushing, rather than a bending effect between the wall surfaces and the ice. Accordingly, depending upon the amount of friction between the surface of the ice and wall surfaces 9, 10 and 11, the wall surfaces 9, 10 and 11 of the blister-like protrusions 2 need not be perfectly vertical. The wall surfaces 9, 10 and 11 may vary from a vertical position to some degree provided that their position during their contact with the ice is below the critical agle $\theta^*$. The critical angle $\theta^*$ exists where the force exerted on the ice changes from crushing to bending, and this angle will vary, depending on the friction between the ice and the surface in contact with the ice. The hull/ice coefficient of slide friction may vary depending on such factors as the roughness and texture of the surface of the hull which is in contact with the ice and the condition of the ice. The critical angle $\theta^*$ is a function of the hull/ice coefficient of a sliding friction. More specifically, the critical angle $\theta^*=\tan^{-1}(\mu)$. Thus, if $\mu=0.20$, then the angle variation $\theta$ would permit an angle of 11.3° from the vertical. The term "generally vertical" as used in this application refers to the orientation of a line or plane which would be positioned at an angle $\theta$ with respect to true vertical during a turn (regardless of the position of the center line of the hull) where $\theta \leqq \tan^{-1}\mu$.

Figure 7:
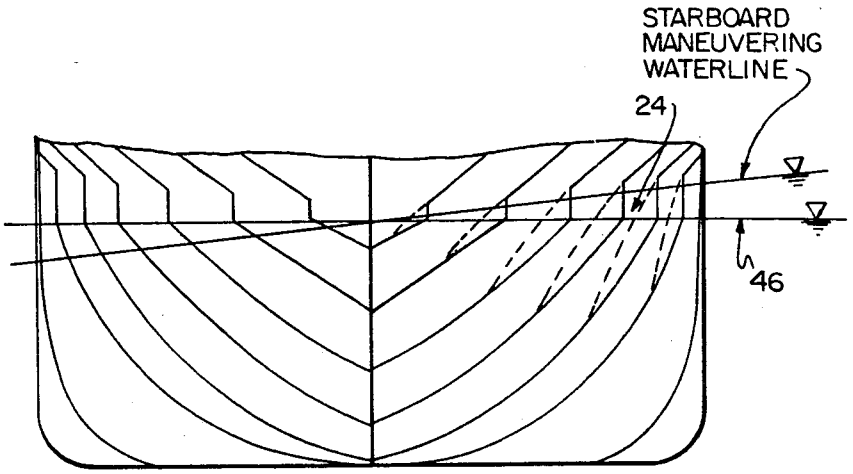
FIG. 7 is an elevational body view of a modified form of the second embodiment for improved sea-keeping.

As mentioned above, it is sometimes desirable to position the protuberances such that they do not extend beyond the maximum beam width. A positioning of the protuberances in this manner is similar in concept to the embodiment shown in FIGS. 4, 5, 6 and 7, which is the second embodiment of this invention. The second embodiment does not include protuberances 2, but includes a variation in the upper portion of the hull bow. The upper portion of the front section of the ship has been modified to include generally vertically oriented surfaces at a location on the hull above the height of the water ice-covering 46, while the vessel is travelling in a straightforward direction. The positioning of the generally vertically oriented surfaces 24 are indicated by frame lines 26*a*–32*a*. The "knuckle line" or point at which the generally sloped configuration formed by the frame lines 25–31 changes to the generally vertical configuration of the surface 24 formed by the frame lines 26*a*–32*a* is indicated at the line 32. The knuckle line is positioned slightly above the straight running water line. The vertical surfaces positioned above the knuckle line 32 continue vertically upward, preferably at least slightly above the anticipated maneuvering water line when the vessel is heeled to one side. It is possible for the hull to flare outward or take any configuration desired above the maneuvering water line. As shown in FIG. 7, the hull flares outward again beyond the maneuvering water line in order to provide proper seakeeping of the vessel.

The second embodiment shown in FIGS. 4–7 is operated in a manner similar to that of the first embodiment described above. The vessel is heeled by a ballasting means or a cargo shifting means within the vessel similar to that of the first embodiment to the port side for a starboard maneuver in order to bring the vertical surfaces 24 on the port side into contact with the ice covering. When the ship is so positioned, the crushing forces are created between the ice on the port side and surfaces 24, whereas bending and breaking forces are being applied on the starboard side. The disparity between the amount of force required to crush ice and the amount of force required to bend and break ice causes the ship to turn to the starboard.

Figure 9:
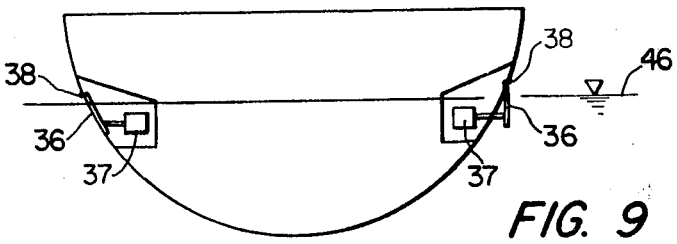
FIG. 9 is a sectional view of one bow frame of the embodiment illustrated in FIG. 8A showing the position of the flaps during a starboard turn.
Figure 10:
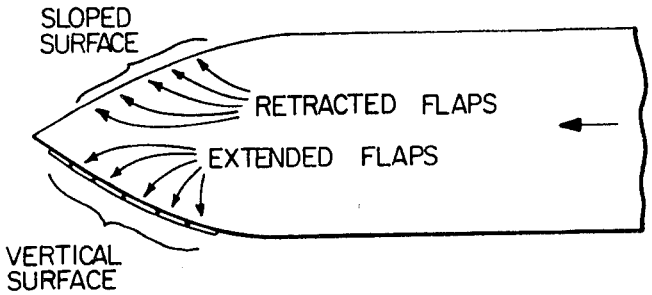
FIG. 10 is a sectional plan view at the waterplane of the embodiment illustrated in FIG. 8A as it would appear during a starboard turn.

A third embodiment of the invention is shown in FIGS. 8, 9 and 10. The third embodiment includes a series of movable flaps 36 positioned along both the port and starboard sides of the vessels. The flaps 36 are symmetrically positioned on the port and starboard sides of the hull at a height corresponding to the height of the water ice covering when the ship is travelling in a straightforward direction. During straightforward travel, the flaps 36 on both sides of the ship are maintained in their retracted position. In their retracted position, the flaps follow the generally sloped configuration of the general contour lines of the hull. Therefore, there is no interference with the general efficiency of the hull design during straightforward operation of the ship. The flaps are preferably of a size that allows them to extend downward from the ice operating water line 46 to a distance greater than the thickness of the ice covering expected to be encountered during operation.

An extension and retraction mechanism 37 is provided for moving the flaps between the retracted hull conforming position and the generally extended vertical position. The flap extension and retraction mechanism 37 may be mechanical, hydraulic, pneumatic or may be electrically actuated, and the specific mechanism does not form a part of the present invention. The flap extension and retraction mechanism 37 should have sufficient structural strength and power to be capable of overcoming the ice-crushing forces that will be encountered by the flaps during maneuvering. The hull changers which support the maneuverable flaps may be sealed in order to prevent the influx of water or ice into the hull. The location and shape of the flaps will vary depending upon the shape and structure of the specific hull, the internal arrangement and anticipated ice operating conditions.

Unlike the embodiments shown in FIGS. 1–7, the third embodiment shown in FIGS. 8–10 does not require the heeling of the vessel in order to obtain the increased maneuverability during a turn. However, it may be desirable, in some instances, to heel the vessel to one side during turning of a vessel which utilizes the flap embodiment. Since the flaps do not extend outward from the maximum beam of the hull when they are in their retracted position, they reduce the clearance necessary for docking. The flaps 36 are hinged for retraction and extension about a longitudinal extending hinge 38 shown in FIG. 9. The connection between the extension and retraction mechanism and the flaps 36 may be by any suitable means, such as a ball joint type connection which allows a rotatable hinge-like movement between the retraction mechanism and the flap.

A specific description of each of the three disclosed embodiments and the method of operation of each of these embodiments has been given above. However, FIG. 1C has been presented in order to more clearly describe the basic concept responsible for the operation of all of the disclosed embodiments and methods of this invention. Although FIG. 1C illustrates the operation of the invention in connection with embodiment 1 utilizing the blister-like protrusions 2, the basic concept of the invention upon which all the embodiments operate is shown in FIG. 1C.

In all the embodiments of the invention, the vessel presents port and starboard hulls having a generally sloped configuration. Therefore, the hull has generally symmetrical forces being applied to it as it moves through the water in a straightforward operation. All the embodiments of the invention also have wall portions and both the port and starboard sides of the ship which may be singly and selectively positioned so as to contact ice on the surface of the water through which the vessel is moving. It should be clearly pointed out that no maneuvering advantage could be obtained by positioning generally vertically oriented wall portions on both sides of the ship into contact with the ice simultaneously. The improved maneuverability is obtained by positioning generally vertically oriented wall portions on one side of the ship into contact with the ice while maintaining the sloped configuration of the hull on the opposite side of the ship in contact with the ice.

In FIG. 1C, the vessel has been heeled to one side by the ballasting means as shown in FIGS. 1A and 1B. This heeling is also utilized in the second embodiment of the invention. In the third embodiment of the invention, the generally vertically oriented wall portions are brought into contact with the ice by the extension of the flaps on one side of the ship. In each of the embodiments, in order to make a starboard turn, the generally vertically oriented wall portions on the port side of the ship are brought into contact with the ice covering such as is shown in FIG. 1C. In addition, the ship's rudder would operate in the usual manner for turning the vessel to the starboard.

The generally vertically oriented wall portions on the port side of the ship exert a crushing force on the ice as demonstrated by arrows $F_c$. This produces a reaction force $F'_c$ which pushes the ship to the starboard side. Simultaneously, on the starboard side of the ship, the generally sloped configuration of the hull continues to apply a bending force to the ice as shown by the arrows $F_b$ which has a horizontal component $F_{bh}$. This produces a reaction force $F'_{bh}$ which pushes the ship to the port side. It is well known that the bending strength of ice is much less than the compression or crushing strength of ice. Therefore, as the ship is driven forward, the resultant difference in the force $F_c'$ and the force $F'_{bh}$ greatly facilitates the turning of the vessel.

The present means and method for increasing the maneuverability of a vessel in ice-covered water has been shown and described herein in what was considered to be the most practical and preferred embodiments. It is recognized, however, that the departures may be made therefrom which are within the scope of the invention and that obvious modifications will occur to one skilled in the art.

What we claim is:

1. A method for increasing the maneuverability of a ship in ice-covered water, such ship comprising a hull including port and starboard sides, each side having sloped portions for applying generally symmetrically distributed force to the ice covering on either side of said hull during straightforward travel and generally vertically oriented wall portions located above said sloped portions on each side of said ship, comprising the steps of:

positioning said ship such that said generally vertically oriented wall portion on one side of said ship is brought into contact with said ice covering while maintaining said sloped portion on an opposite side of said ship in contact with said ice covering; and propelling said ship in a forward direction while maintaining said generally vertically oriented wall portion on said one side of said ship in contact with said ice while continuing to maintain said sloped portion on said opposite side of said ship in contact with said ice covering for a time sufficient to assist in a turning maneuver of said ship in the direction of said opposite side.

2. A method for increasing the maneuverability of a ship in ice-covered waters, said ship comprising a hull including port and starboard sides, each side having sloped portions for applying generally symmetrically distributed forces to the ice covering on either side of said hull during straightforward travel, and generally vertically oriented wall portions located above said sloped portions on each side of said ship wherein an angle $\theta$ of said generally vertically oriented wall portions with respect to the vertical is $\theta \leqq \tan^{-1}(\mu)$ where $\mu$=the coefficient of friction between the vertically oriented wall portion and the ice, comprising the steps of:

positioning at said angle $\theta$, said generally vertically oriented wall portion on one side of said ship into contact with said ice covering while maintaining said sloped portion on an opposite side of said ship in contact with said ice covering; and propelling said ship in a forward direction while maintaining said generally vertically oriented wall portion on said one side of said ship in contact, at an angle $\theta$, with said ice covering while continuing to maintain said sloped portion on said opposite side of said ship in contact with said ice covering for a time sufficient to assist in a turning maneuver of said ship in the direction of said opposite side.

3. A means for increasing the maneuverability of a ship in ice-covered waters, wherein said ship comprises a hull including port and starboard portions having sloped portions for applying a generally symmetrically distributed bending force to the ice covering on either side of said ship during straightforward travel comprising:

turn-assisting means positioned on said port and starboard hull portion, said turn-assisting means being positionable out of contact with said ice-covering during straightforward travel of said ship, said turn-assisting means including wall portions positionable in a generally vertically oriented position in contact with said ice-covering; and positioning means for selectively positioning one of said turn-assisting means into a position in contact with said ice-covering at an angle $\theta$ with respect thereto wherein the angle $\theta$ of said generally vertically oriented wall portions with respect to the vertical is $\theta \leqq \tan^{-1}(\mu)$ where $\mu$ equal the coefficient of friction between the vertically oriented wall portion and the ice while maintaining the sloped portions on the opposite side of said ship in contact with said ice covering during the turning of said ship.

4. A means for increasing the maneuverability of a ship in ice-covered waters, wherein said ship comprises a hull including port and starboard portions having sloped configurations for applying a generally symmetrically distributed bending force to the ice covering on either side of said ship during straightforward travel comprising:

turn-assisting means comprising protrusions symmetrically positioned on said port and starboard portions of said hull at a position above said ice-covering during straightforward travel, said protrusions including generally vertically oriented wall portions; and positioning means within said hull for selectively positioning said hull in a manner such that said generally vertically oriented wall portions of said turn-assisting means is brought into contact with said ice covering at angle $\theta$ with respect thereto, wherein the angle $\theta$ of said generally vertically oriented wall portions with respect to the vertical is $\theta \leqq \tan^{-1}(\mu)$ where $\mu$ equals the coefficient of friction between the vertically oriented wall portion and the ice while maintaining said generally vertically oriented wall portion of said turn-assisting means positioned on the opposite side of said hull out of contact with said ice covering during the turning of said ship.

5. A means for increasing the maneuverability of a ship in ice-covered waters as claimed in claim 4, wherein said positioning means is a ballasting means.

6. A means for increasing the maneuverability of a ship in ice-covered waters as claimed in claim 4, wherein said positioning means is a cargo shifting means.

7. A means for increasing the maneuverability of a ship in ice-covered waters, as in claim 4, wherein one of said wall portions on each of said protrusions is positioned closest to the bow of said ship, each of said one wall portions being inclined inwardly toward said hull, said inclination being inward toward said hull in the direction of said bow.

8. A means for increasing the maneuverability of a ship in ice-covered waters, wherein said ship comprises a hull including port and starboard portions having sloped configurations for applying a generally symmetrically distributed bending force to the ice covering on either side of said ship during straightforward travel comprising:

turn-assisting means positioned on said port and starboard hull portions, said turn-assisting means comprising generally vertically oriented wall portions extending upwardly from said sloped configurations of said hull, said generally vertically oriented wall portions being positioned above said ice covering during straightforward travel; and positioning means within said hull for selectively positioning said hull in a manner such that one of said vertically oriented wall portion of said turn-assisting means is brought into contact with said ice covering, at an angle $\theta$ with respect thereto where the angle $\theta$ of said generally vertically oriented wall portions with respect to the vertical is $\theta \leqq \tan^{-1}(\mu)$ where $\mu$ equals the coefficient of friction between the vertically oriented wall portion and the ice while maintaining said vertically oriented wall portions of said turn-assisting means positioned on the opposite side of said hull out of contact with said ice covering during the turning of said ship.

9. A means for increasing the maneuverability of a ship in ice-covered waters as claimed in claim 8, wherein said positioning means is a ballasting means.

10. A means for increasing the maneuverability of a ship in ice-covered waters as claimed in claim 8, wherein said positioning means is a cargo shifting means.

11. A means for increasing the maneuverability of a ship in ice-covered waters wherein said ship comprises a hull including port and starboard portions having sloped configurations for applying a generally symmetrically distributed bending force to the ice covering on either side of said ship during straightforward travel comprising:

turn-assisting means positioned on said port and starboard hull portions of said ship, said turn-assisting means on said port and starboard hull portions each comprising a plurality of flaps, said flaps including wall portions movable between a retracted hull conforming position and a generally extended vertical position; and positioning means for selectively positioning to extend said flaps on one of said port or starboard side into contact with said ice-covering at an angle $\theta$ with respect thereto, wherein the angle $\theta$ of said generally vertically oriented wall portions with respect to the vertical is $\theta \leqq \tan^{-1}(\mu)$ where $\mu$ equals the coefficient of friction between the vertically oriented wall portion and the ice while maintaining said flaps on the opposite side of said ship in said retracted hull conforming position.

* * * * *